US006338470B1

(12) United States Patent
Steely et al.

(10) Patent No.: US 6,338,470 B1
(45) Date of Patent: Jan. 15, 2002

(54) POWERED LIFT FOR RAISING A TWO-WHEELED VEHICLE

(76) Inventors: Kevin L. Steely, 3859 Country Club Rd., Petoskey, MI (US) 49770; Lawrence A. MacEachern, 9700 Whitefield Rd., East Jordan, MI (US) 49727

( * ) Notice: Subject to any disclaimer, the term of this patent is extended or adjusted under 35 U.S.C. 154(b) by 0 days.

(21) Appl. No.: 09/731,078

(22) Filed: Dec. 5, 2000

(51) Int. Cl.[7] ..... B66F 3/00

(52) U.S. Cl. ..... 254/124; 254/126; 254/91; 254/134

(58) Field of Search ..... 254/8 R, 124, 254/8 B, 8 C, 9 R, 9 B, 9 C, 10 R, 10 B, 10 C, 133, 144, 88, 3 B, 3 C; 212/184; 280/763.1, 764.1; 211/5, 22

(56) References Cited

U.S. PATENT DOCUMENTS 3,330,381 A * 7/1967 Halstead ..... 254/91
3,709,330 A * 1/1973 Wells et al. ..... 254/91
3,948,106 A * 4/1976 Armbruster ..... 254/1
4,681,299 A * 7/1987 Siebert ..... 254/124
5,211,376 A * 5/1993 Anderson ..... 254/134
D344,835 S 3/1994 MacEachern
5,518,224 A * 5/1996 Anderson ..... 254/131

OTHER PUBLICATIONS

Undated trade publication of Autec Hefbruggen BV, Montfoort, The Netherlands, "The Real Thing!", one page.

* cited by examiner

*Primary Examiner*—Joseph J. Hail, III
*Assistant Examiner*—Daniel Shanley
(74) *Attorney, Agent, or Firm*—Brooks & Kushman P.C.

(57) ABSTRACT

A lifting rack for elevating motorcycles or other two-wheeled vehicles for ease of maintenance. The rack comprises a channel with a base plate that may be laid flat on a ground or floor surface, and upstanding side walls that provide lateral stability for a two-wheeled vehicle as the vehicle wheels are positioned on the base plate. The rack also comprises ground or floor surface engaging rails. A linkage mechanism connects the rails to the channel. A hydraulic motor, anchored on the rails, applies a lifting force to the linkage elements, thereby creating a vertical lift force component, the base plate supporting the vehicle wheels as the vehicle lifted. One end of the channel may be separated from the main portion of the channel and separately articulated on the rails, whereby one vehicle wheel may overhang the end of main channel portion.

10 Claims, 6 Drawing Sheets

POWERED LIFT FOR RAISING A TWO-WHEELED VEHICLE

TECHNICAL FIELD

The invention relates to lift racks for maintenance of a two-wheeled vehicle.

BACKGROUND ART

In servicing a motorcycle, it is necessary or desirable to lift the motorcycle to make undercarriage vehicle components accessible for repair or maintenance purposes. Prior art mechanisms for lifting motorcycles usually include a platform connected to a base by an articulated linkage. The motorcycle is loaded on the platform when the platform is lowered toward the ground or floor surface that supports the lift. Provision is made in such known construction for actuating the linkage that connects the platform to the base using a fluid motor. An example of a construction of this type may be seen by referring to a catalog published by Autec Hofbruggen BV in the Netherlands. Lifts similar to the Autec lift have been used also to raise water craft and garden tractors for maintenance purposes. An example of a lift of this kind is disclosed in U.S. Patent Design 344,835.

In the prior art constructions, the lift track and the mechanism for lifting the motorcycle require the operator to wheel the motorcycle onto the platform which is raised from the surface that supports the lift track. Because of the weight of the vehicle, it is necessary to use a ramp device for raising the vehicle to the level of the platform before the platform is raised. Lift mechanisms of conventional design further require special stabilizing structural members for the motorcycle, which add to the overall weight of the lift. Further, the overall width of conventional lift mechanisms, including the load-supporting platform, is usually much wider than the transverse width of the motorcycle itself. This encumbers access to the undercarriage of the motorcycle for maintenance purposes.

DISCLOSURE OF INVENTION

It is an objective of the invention to provide a medium-weight lift rack assembly for a motorcycle and other two-wheeled vehicles wherein the vehicle can be wheeled by the operator onto the rack before it is raised. The operator thus can drive or roll the motorcycle onto the track and deploy the usual side stand prior to raising of the lift rack. The operator then can dismount the vehicle and secure the motorcycle properly before it is elevated.

The lift rack of the invention prevents transverse deviation of the motorcycle wheels by providing side walls on the base of the lift rack, which center the motorcycle on the lift rack.

The overall width of the lift track of the invention is narrower than the width of the motorcycle itself. This provides an unobtrusive profile for the lift rack and permits unencumbered access to the undercarriage of the motorcycle for maintenance purposes.

The motorcycle is lifted as the lift rack engages the motorcycle tires rather than the frame of the vehicle itself. This prevents possible damage to vehicle body work or paint.

The lift rack of the invention may be used in tandem with another lift rack of the same design to create a lifting mechanism for four-wheeled vehicles, such as lawn tractors or four-wheel all-terrain vehicles.

The lift rack includes an upper channel that is engaged by the tires of the vehicle. The upper channel has a base plate that rests on the ground or floor when the lift rack is lowered. A forward portion of the channel may be detachable from a main channel section. This permits the motorcycle front wheel to overhang the main track section for purposes of tire service or wheel removal without the necessity for using an external jack device. Rear wheel servicing also can be accommodated by reversing the position of the vehicle on the channel.

The lift rack assembly includes ground or floor engaging rails that are connected to the upper channel by parallelogram linkage elements or arms. A fluid motor, supported by the rails, activates the linkage elements to raise the upper channel.

A further feature of the invention is its lightweight design, which facilitates storage when the rack is not in use. Compared to known lift rack designs, the invention also improves the degree of safety in servicing the motorcycle because of its improved stabilizing characteristics.

The lift rack of the present invention can be adapted readily for storage by employing casters mounted on its forward end, thereby permitting an operator to raise the opposite end of the lift rack so that the assembly can be wheelbarreled to a storage location. A stabilizer bar is connected to the rails to provide lateral stability. A tie-down bar is connected to the upper channel to provide an anchor for tie-down straps connected to the vehicle.

BEST MODE FOR CARRYING OUT THE INVENTION

Figure 1:
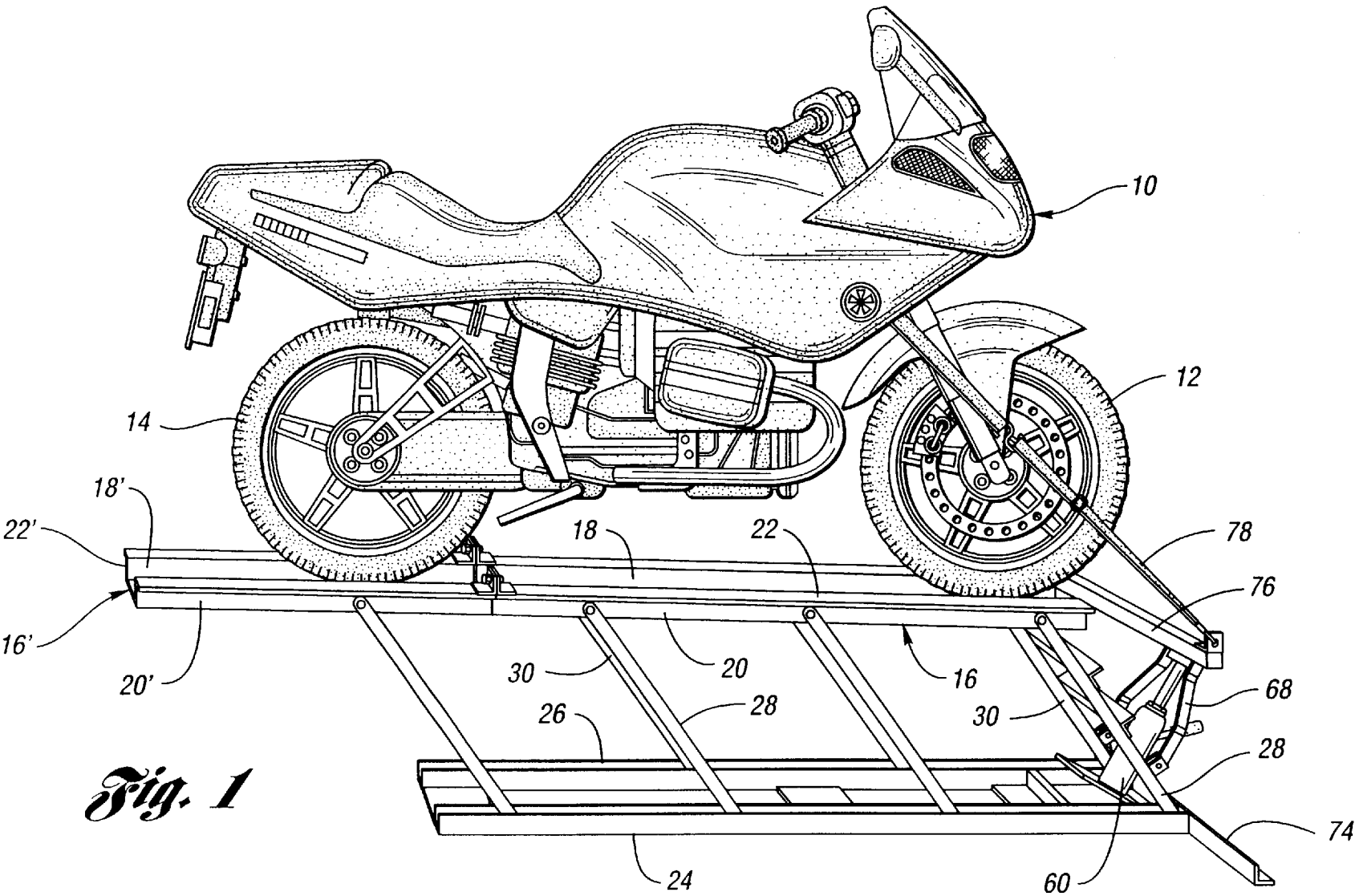
FIG. 1 shows in perspective a raised motorcycle mounted on the lift rack of the invention.

FIG. 1 shows in side elevation a motorcycle 10 having a forward wheel 12 and a rear wheel 14 resting on structural main channel 16. The channel 16 includes side walls 18 and 20 on the lateral sides of a base plate 22. The wheels rest directly on the base plate 22. The side walls 18 and 20 prevent lateral displacement of the wheels relative to the base plate 22. Base plate 22 rests on the ground or floor when the lift rack is lowered.

Ground or floor engaging rails 24 and 26 are located below the motorcycle supporting upper main channel 16. Linkage arms or elements 28 and 30 are pivotally connected at their ends to the channel 16 and to the lower rails 24 and 26. Additional pairs of linkage elements corresponding to linkage elements 28 and 30 are spaced longitudinally along the length of the channel 16 and the rails 24 and 26, thereby defining a series of parallelogram linkages.

Figure 2:
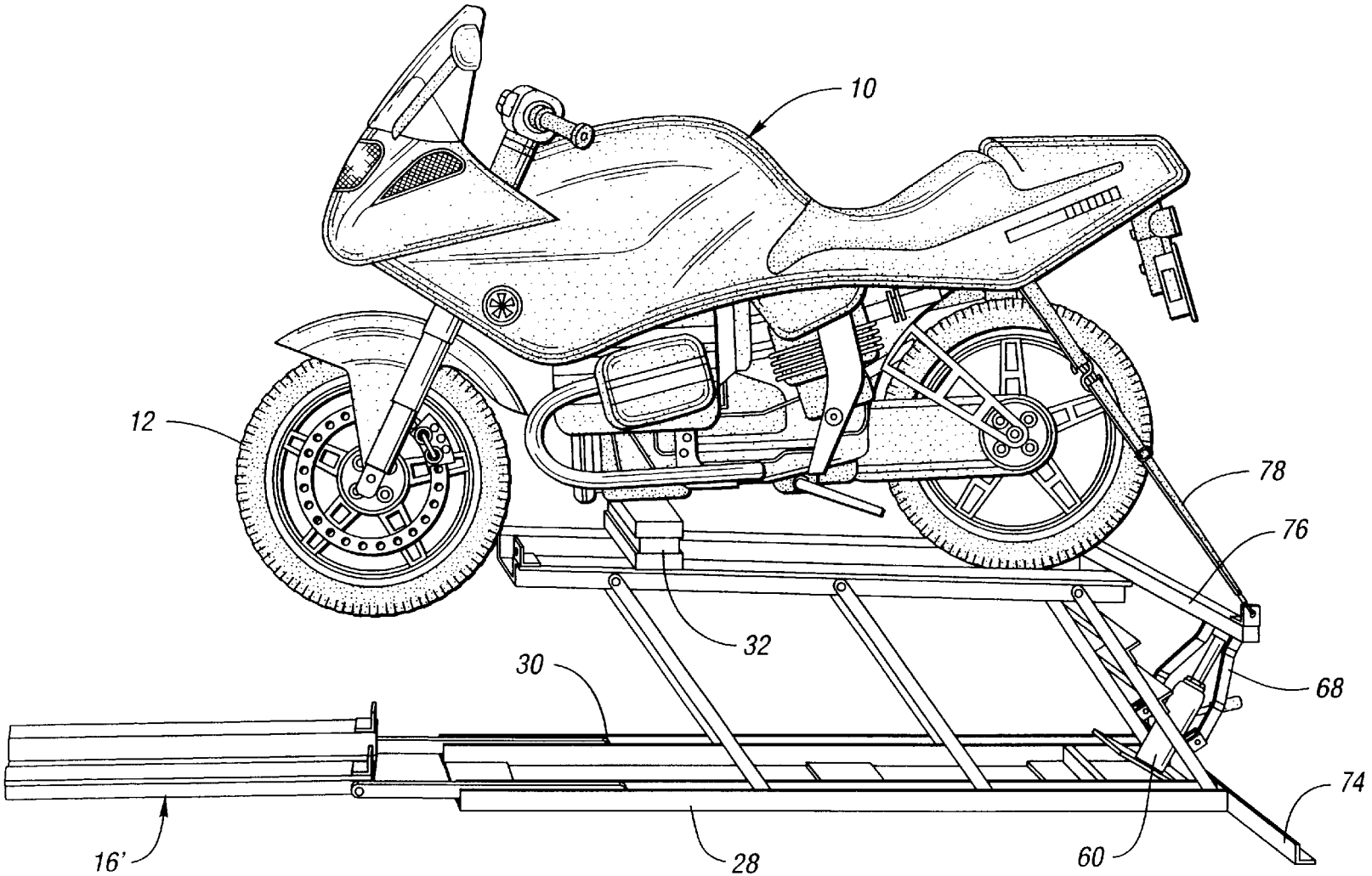
FIG. 2 shows the vehicle and lift rack assembly of FIG. 1 wherein the front section of the track-engaging channel is lowered to permit access to the front wheel of the vehicle.

FIG. 2 shows the forward section 16' of the main channel 16 in a lowered position. It is disconnected from the adjacent edge of the main channel 16, thereby allowing the wheel 12 to overlie the main channel 16. A block 32 is used to support the chassis of the motorcycle 10 when the wheel 12 overlies the main channel. This permits the wheel 12 to be located where it can be serviced easily by the operator. If the position of the motorcycle were to be reversed, as indicated in FIG. 1, servicing of the rear wheel is facilitated.

Figure 6:
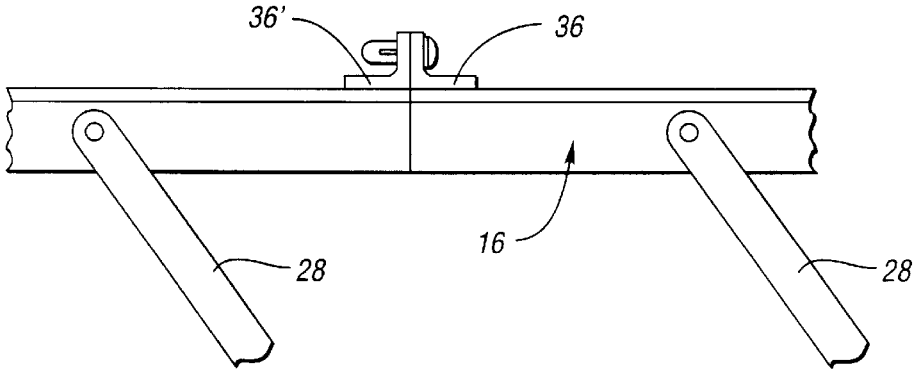
FIG. 6 is a subassembly view showing a forward channel section when it is secured to form an extension of a main channel section.
Figure 7:
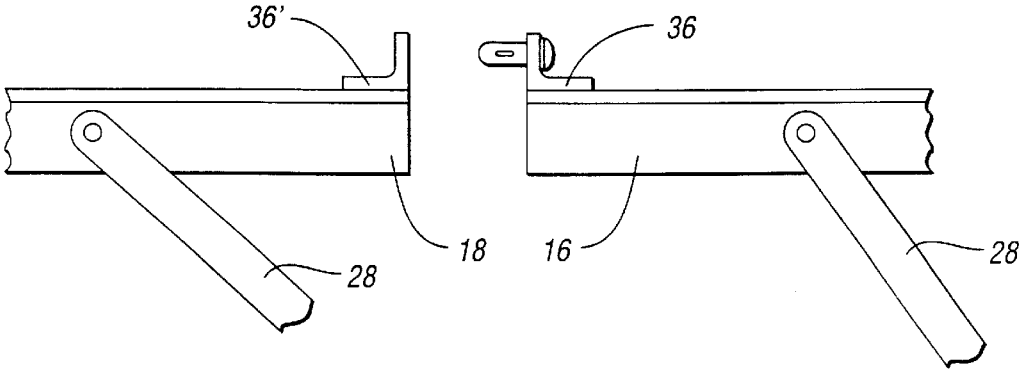
FIG. 7 is a view similar to FIG. 6 wherein the forward channel section has been moved away from the end of the main channel section.
Figure 8:
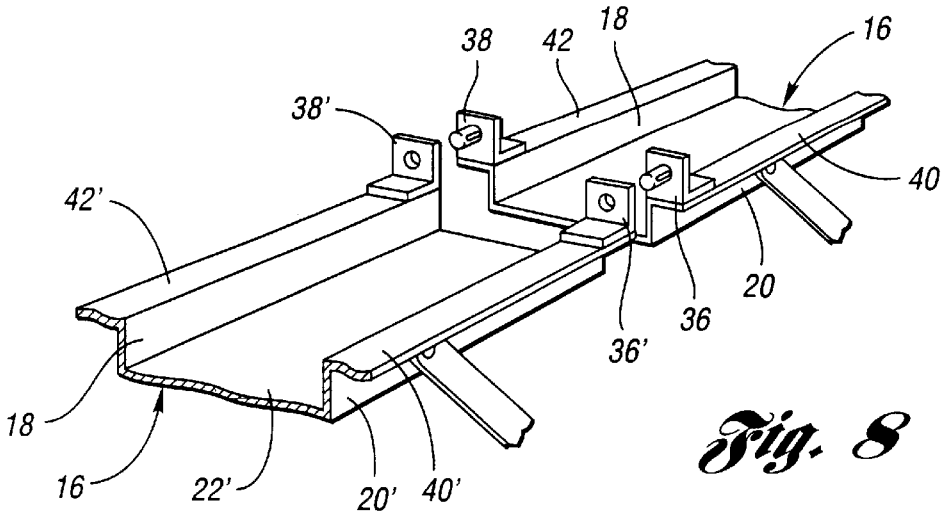
FIG. 8 is an isometric view of the main channel section and the forward channel section seen in FIG. 7.
Figure 9:
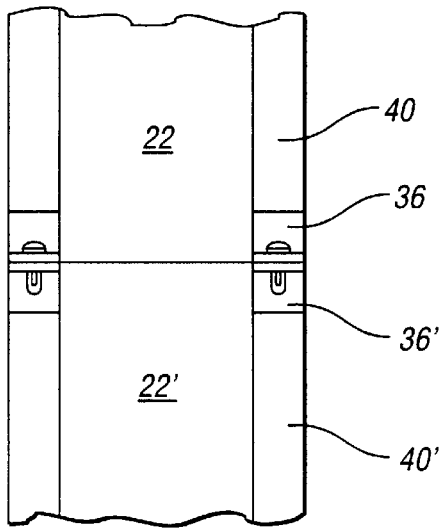
FIG. 9 shows a top view of the forward channel section and the main channel section.

As best seen in FIGS. 8 and 9, a pair of angle brackets 36 and 38 is secured to the top surfaces 40 and 42 of the channel 16. Corresponding brackets 36' and 38' are secured to top surfaces of channel section 16'. The brackets 36 and 38 and the corresponding brackets 36' and 38' each have a hole through which a locking pin is located. The locking pin for one side of the channel 16 is shown in FIG. 7 at 44. It is received in an opening 44' in the angle bracket 36'. A hitch clip, received through an opening in the pin 44, holds the angle brackets in the engaged position shown in FIG. 6.

Figure 10:
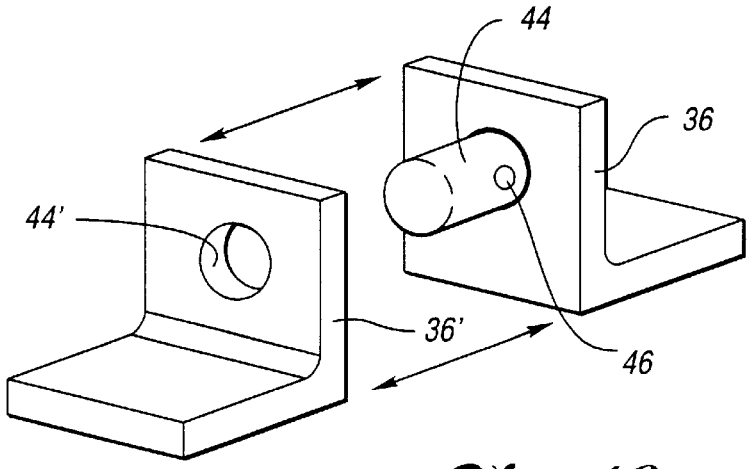
FIG. 10 is a view of a bracket structure for connecting the forward channel section to the main channel section.

FIG. 9 shows a top view of the connection between the forward section 16' of the load-supporting channel and the main channel 16. FIG. 10 shows a detailed view of the locking pin connection between the forward channel section and the main channel section when the brackets 36 and 36' are disengaged. The hitch clip hole is shown in FIG. 10 at 46.

Figure 11:
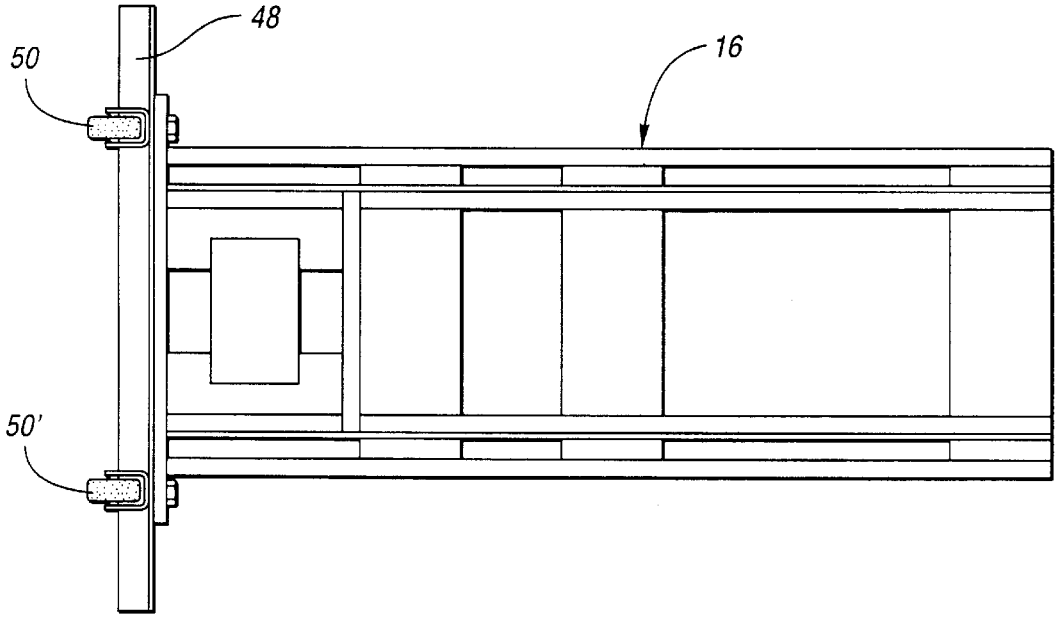
FIG. 11 is a plan view of the lift rack of the invention wherein caster wheels are assembled to the front end of the lift rack.

FIG. 11 shows a mounting bar 48 secured to one end of the lift track structure. Casters 50 and 50' are mounted on the bar 48, as shown in FIG. 11. at a spacing preferably greater than the width of the channel 16.

Figure 12:
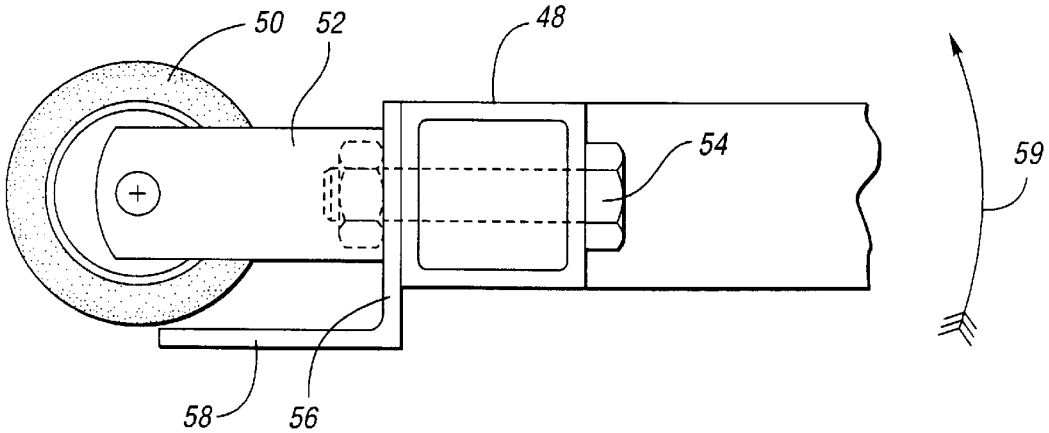
FIG. 12 is a side elevation view of a portion of the lift rack and the caster assembly of FIG. 11.

The partial sectional view of FIG. 12 shows the mounting bar 48, which may be in the form of a square structural section. The casters 50 and 50' are supported on axle brackets 52, which are joined to the bar 48 by bolts 54. An angle bracket 56 is secured as shown to the bar 48. It includes a floor engaging portion 58 that is slightly below the periphery of the caster 50. This creates a clearance between the casters and the floor. The clearance is reduced to zero when the track is tilted in the direction of the arrow 59 in FIG. 12. When the lift track structure is lowered to the floor-engaging position, the operator may move the lift track in a wheel barrel fashion to a storage area.

Figure 3:
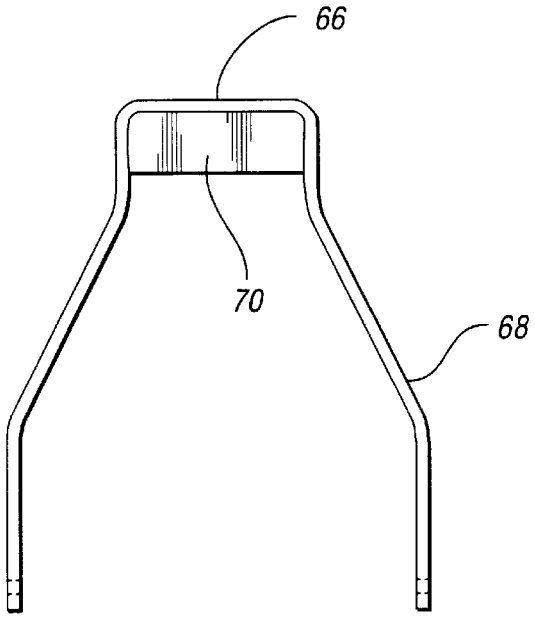
FIG. 3 is a detailed view of a yoke and yoke reinforcement for a fluid motor for raising lift linkage arms of the lift rack structure.
Figure 3A:
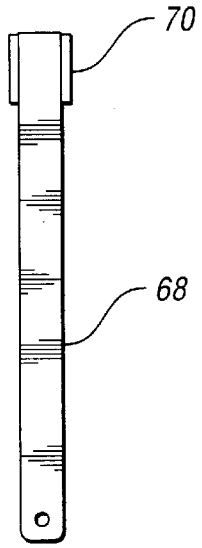
FIG. 3*a* is a side view of the yoke shown in FIG. 3.
Figure 4:
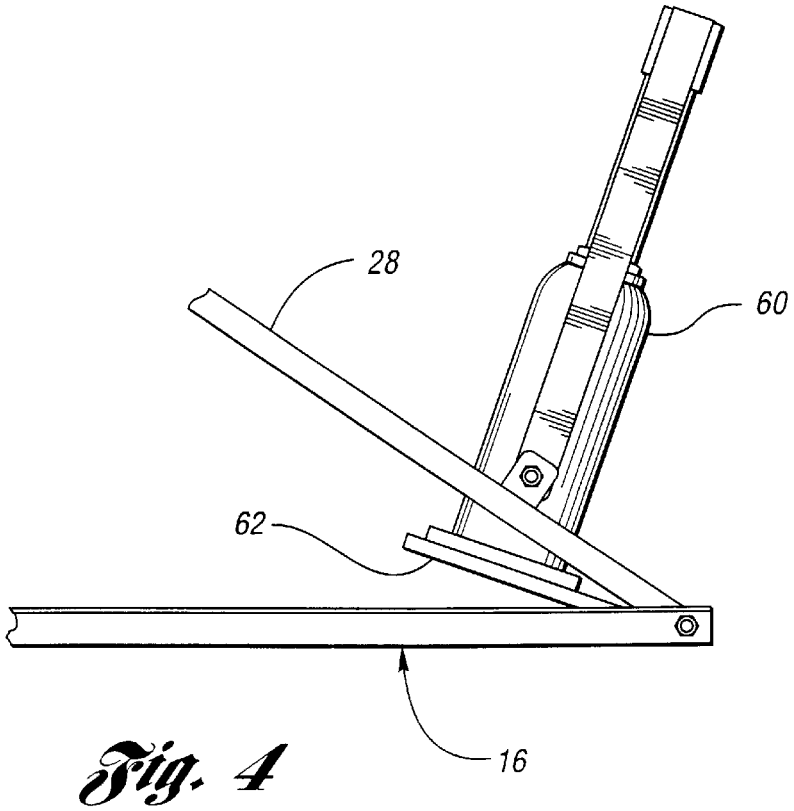
FIG. 4 is a partial assembly view of the fluid motor, including the yoke of FIG. 3, for raising the articulated linkage arms for the lift rack structure of the invention.
Figure 5:
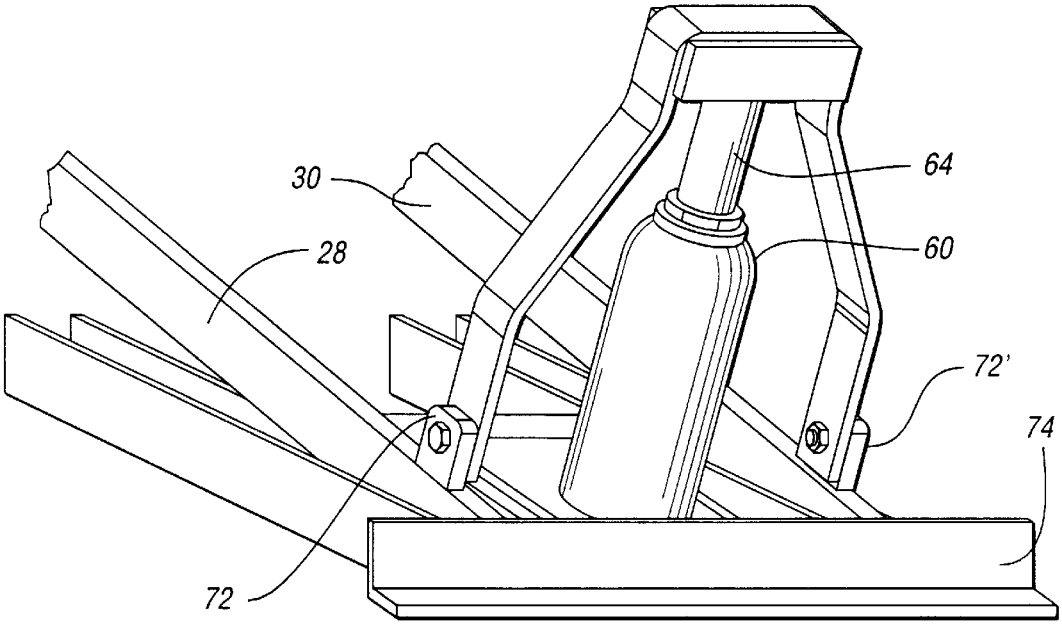
FIG. 5 is an isometric view showing the fluid motor and forward linkage arms for the lift rack of the invention.

FIGS. 4 and 5 show a subassembly view of a hydraulic pump 60. It includes a cylinder housing mounted on a support plate 62 secured to the rails 24 and 26. The pump 60 includes a piston rod 64 secured to the center 66 of a yoke 68, as seen in FIGS. 3 and 5. A reinforcement bracket 70 may be provided at the location of the connection between the piston 64 and the center 66. The lower end of the arms of the yoke 68 are connected, as shown in FIG. 5 at 72 and 72', to rearward linkage elements 28 and 30. When the pump 60 is activated, the yoke seen in FIG. 3 will raise the linkage elements 28 and 30 to the position shown in FIG. 1. All of the linkage elements 28 and 30 will move in unison because of the parallelogram construction of the lift track. The connection between the linkage elements and the linkage elements 28 and 30 may be about one-quarter to one-third of the distance from the lower ends of the linkage elements to the upper ends.

A stabilizer bar 74, seen in FIGS. 2 and 5, is secured to one end of the rails 24 and 26 to provide lateral stability for the lift rack.

A tie-down bar 76 is connected to the top of the main channel 16 as seen in FIGS. 1 and 2. A tie-down strap 78, which is connected to a frame member of the vehicle, is attached to each end of the tie-down bar to stabilize the vehicle on the lift rack.

Although one embodiment of the invention has been disclosed, it will be apparent to persons skilled in the art that modifications may be made without departing from the scope of the invention. All such modifications and equivalents thereof are intended to be covered by the following claims.

What is claimed is:

1. A lift rack assembly for raising a two-wheel vehicle from ground level to an elevated position to permit maintenance of the vehicle;

the assembly comprising a structural main channel with a base portion engageable with the ground and a pair of side shoulders defining an open channel profile, the channel positioning and stabilizing forward and rearward vehicle wheels as the vehicle is moved over the main channel;

a pair of ground-engaging rails disposed in parallel relationship with respect to the main channel;

a plurality of linkage arms pivotally connected at their opposite ends to the main channel and the rails, the linkage arms being located at longitudinal locations along the main channel thereby defining a parallelogram linkage system; and a hydraulic pump having a piston member and a cooperating cylinder member, one pump member being connected to the rails and the other pump member being connected to a pair of the linkage arms whereby the linkage arms are moved about their pivotal connections as the main channel elevates the vehicle above ground level.

2. The lift rack assembly set forth in claim 1 wherein the connection between the other pump member and the linkage arms includes a structural yoke with a center section connected to the other pump member and yoke arms connected to transversely spaced linkage arms.

3. The lift rack set forth in claim 1 wherein the main channel, when the lift rack is lowered, engages the ground whereby the vehicle can be wheeled onto the main channel without a requirement for a ramp device.

4. The lift rack set forth in claim 2 wherein the main channel, when the lift rack is lowered, engages the ground whereby the vehicle can be wheeled onto the main channel without a requirement for a ramp device.

5. The lift rack set forth in claim 1 wherein the main channel comprises a forward channel section and a rearward channel section, the forward channel section being releasably secured to the rearward channel section in end-to-end relationship;

the one vehicle wheel being supported on the forward channel section and the other vehicle wheel being supported on the rearward channel section;

the forward channel section being releasable from the rearward channel section to allow the one vehicle wheel to overhang the rearward channel section whereby the one vehicle wheel may be serviced.

6. The lift rack set forth in claim 2 wherein the main channel comprises a forward channel section and a rearward channel section, the forward channel section being releasably secured to the rearward channel section in end-to-end relationship;

the one vehicle wheel being supported on the forward channel section and the other vehicle wheel being supported on the rearward channel section;

the forward channel section being releasable from the rearward channel section to allow the one vehicle wheel to overhang the rearward channel section whereby the one vehicle wheel may be serviced.

7. The lift rack assembly set forth in claim 1 wherein the overall lateral width of the lift rack assembly is substantially less than the overall lateral width of a two-wheel vehicle supported on the main channel whereby access to lower regions of the vehicle is provided.

8. The lift rack assembly set forth in claim 2 wherein the overall lateral width of the lift rack assembly is substantially less than the overall lateral width of a two-wheel vehicle supported on the lift rack assembly whereby access to lower regions of the vehicle is provided.

9. The lift rack assembly set forth in claim 1 including a tie-down bar connected to the main channel and extending laterally from the lift rack assembly whereby tie-down straps may be connected to the tie-down bar to secure the vehicle when it is mounted on the lift rack assembly.

10. The lift rack assembly set forth in claim 1 wherein a stabilizer bar is connected to one end of the rails, the stabilizer bar extending laterally from the lift rack assembly.

* * * * *